US008491321B2

(12) United States Patent
Kobayashi

(10) Patent No.: US 8,491,321 B2
(45) Date of Patent: Jul. 23, 2013

(54) PLUG-IN CONNECTOR FOR DC WIRING

(75) Inventor: Susumu Kobayashi, Osaka (JP)

(73) Assignee: Panasonic Corporation, Kadoma-shi (KP)

( * ) Notice: Subject to any disclaimer, the term of this patent is extended or adjusted under 35 U.S.C. 154(b) by 1 day.

(21) Appl. No.: 13/378,881

(22) PCT Filed: Jun. 4, 2010

(86) PCT No.: PCT/JP2010/059528

§ 371 (c)(1),
(2), (4) Date: Jan. 5, 2012

(87) PCT Pub. No.: WO2010/147008

PCT Pub. Date: Dec. 23, 2010

(65) Prior Publication Data

US 2012/0094549 A1 Apr. 19, 2012

(30) Foreign Application Priority Data

Jun. 18, 2009 (JP) ..... 2009-145763

(51) Int. Cl.
*H01R 13/53* (2006.01)

(52) U.S. Cl.
USPC ..... 439/181; 439/188

(58) Field of Classification Search
USPC ..... 439/181, 188
See application file for complete search history.

(56) References Cited

FOREIGN PATENT DOCUMENTS

| | | | |
|---|---|---|---|
| JP | 10-144424 | A | 5/1998 |
| JP | 2004-158331 | A | 6/2004 |
| JP | 2006-244977 | A | 9/2006 |
| JP | 2007-329046 | A | 12/2007 |

OTHER PUBLICATIONS

International Search Report dated Jul. 6, 2010, issued for PCT/JP2010/059528.

*Primary Examiner* — Ross Gushi
(74) *Attorney, Agent, or Firm* — Edwards Wildman Palmer LLP

(57) ABSTRACT

An objective is to produce the plug-in-connector for DC-wiring with safety by preventing degradation of contact points by shortening of period when arc is caused due to detaching and attaching the plug. An electrical outlet comprises an inversion-spring electrically connected to the plug's blade inserted from the insertion-hole. Both the ends of the inversion-spring are fixed to the inversion-spring's body, whereby the inversion-spring's intermediate-portion is moved between the contact position of making an elastically contact with the blade and the non-contact position of making a space having a predetermined distance or more for cutting the arc. The blade pushes the intermediate-portion to move it to the non-contact position by twisting the plug having a contact condition between the intermediate-portion and the blade. The intermediate-portion is inverted to have an elastic contact to the blade by pushing the push button to move the intermediate-portion, with non-contact position, by the driving member.

3 Claims, 8 Drawing Sheets

PLUG-IN CONNECTOR FOR DC WIRING

TECHNICAL FIELD

This invention relates to a plug-in connector for DC wiring.

BACKGROUND ART

Recently, as a measure against global warming, there is a requirement of the greenhouse gas mitigation. According to this requirement, the reduction of the electrical power consumption is tried in order to reduce an amount of carbon dioxide emission which is caused by the energy.

In the standard home, various home electrical appliances are used. In the present situation, a plurality of the home electrical appliances are operated by the alternating current source. Therefore, the electrical power company supplies the alternating current power to the standard home, whereby the home electrical appliances are operated. In contrast, some home electrical appliances such as an air conditioner, a refrigerator, and a washing machine having inverter control types are increased. The electrical equipment having the inverter control type is configured to once convert the alternating current power supplied from the outlet in the home into the direct current power by the AC/DC converter in the electrical equipment, and then convert the direct current power into the alternating current power by the inverter circuit, whereby the load is operated. Therefore, the electrical equipment is configured to perform twice conversions of converting the alternating current power into the direct current power and converting the direct current power into the alternating current power. This conversion faces the problem of increasing the power loss due to the electrical power conversions.

In view of this, the applicant have proposed the AC/DC hybrid wiring system which comprises a prior alternating current wiring system and a direct current wiring system for supplying the direct current power. In the direct current power supplied by the AC/DC hybrid wiring system, the arc is developed between the insertion plug and the plug receiver (the electrical outlet) in the plug-in connector when the insertion plug is attached and detached. The arc becomes a problem in view of the safety.

In the alternating current, the voltage is alternated between the positive voltage and the negative voltage across zero volt. Therefore, the voltage is set to be zero in every half cycle of the cycle of the electrical power. Therefore, there is a condition of easily extinguishing the arc. In contrast, the direct current power has a constant voltage. This results in the continuation of the arc discharge.

The plug-in connector for DC wiring having a means of preventing the development of the arc by employing the connection member having the low-value resistance connector and the high-value resistance connector in the electrical outlet is disclosed in Patent literature 1 hereinafter explained. In the electrical outlet of the Patent literature 1, the blade of the plug comes into contact with the low-value resistance connector after comes into contact with the high-value resistance connector when the blade of the insertion plug is inserted into the blade insertion hole. In addition, when the insertion plug is removed from the electrical outlet, the blade is moved away from the low-value resistance connector under a condition where the blade is in contact with the high-value resistance connector. Then, the blade is moved away from the high-value resistance connector. In the plug-in connector for DC wiring of the above, when the electrical connection between the blade and the connection member is disconnected, the electrical current flows in the high-value resistance connector. In addition, when the electrical connection between the blade and the connection member is established, the electrical current flows in the high-value resistance connector. Consequently, this configuration makes it possible to prevent the development of the arc.

PRIOR ART

Patent Literature

Japanese patent publication No. 2004-158331 A

DISCLOSURE OF THE INVENTION

Problem to be Solved by the Invention

The above electrical outlet disclosed in Patent literature 1 has a necessary of employing "the low-value resistance connector which is in contact with the blade under a condition where the insertion plug is connected to the electrical outlet", and "the high-value resistance connector which has a shape which is completely different from the shape of the low-value resistance connector". Therefore, there is a problem of the increase of the cost of the electrical outlet.

In addition, when the blade comes into contact with the connection member and when the blade is moved away from the connection member, the electrical current is flown through the high-value resistance connector. Consequently, the electrical current is limited. However, there is a possibility of failing to limit the electrical current. In this case, if the speed of inserting and removing the insertion plug is slow, the period of flowing a large amount of the electrical current to the contact portion is increased. This results in the degradation and the wastage of the contact portion.

This invention is achieved to solve the above objective. An objective of this invention is to produce the plug-in connector for DC wiring which is improved its safety by shortening "the period of time of developing the arc when the insertion plug is inserted and removed" to prevent the degradation of the contact portion.

Means of Solving the Problem

In order to achieve the above explained objective, this invention discloses the plug-in connector for DC wiring. The plug-in connector for DC wiring comprises an insertion plug and a plug receiver. The insertion plug comprises blades. The plug receiver comprises insertion holes and a connection member. The insertion holes are provided for inserting the blades. The connection member is electrically connected to the blades which are inserted from the insertion holes. The connection member comprises inversion springs. At least one of ends of each the inversion spring is fixed. The inversion springs have electrical conductivities. Each the inversion spring has an inversion portion which is invertible between a contact position and a non-contact position. When the inversion portion is located in the contact position, the inversion portion is projected toward the blades which are inserted from the insertion holes. Consequently, the blades are in elastic contact with the blades, respectively. When the inversion portion is located in the non-contact position, the inversion portion is spaced from the blade by a predetermined distance or more. The predetermined distance is defined by a distance for cutting a flow of arc. When the body of the insertion plug is moved in a plug attachment and detachment operation, a part of the insertion plug is configured to push the inversion portion. When operation of pushing the inversion portion is performed, at least one of on-operation and off-operation is performed. The on-operation is defined by operation of inverting the inversion spring to move the inversion spring to a contact position side. The off-operation is defined by operation of inverting the inversion spring to move the inversion spring to a non-contact position side.

In addition to the above plug-in connector for DC wiring, it is preferred that the each blade which is a part of the insertion plug is configured to push the inversion portion which is located in the contact position according to the operation of moving the body of the insertion plug. When each the inversion portion is inverted to be moved to the non-contact position by pushing the inversion portion which is located in the contact position, the off-operation is performed. In addition, the insertion plug comprises driving members. A surface of the body of the insertion plug comprises a push button. Each the driving member is configured to push the inversion portion which is located in the non-contact position when a push operation of pushing the push button is performed. Each the inversion portion is inverted to move from the non-contact position to the contact position when the push operation of pushing the push button is performed.

In addition to the above plug-in connector for DC wiring, it is preferred that each the blade which is defined as a part of the insertion plug is configured to push the inversion portion which is located in the contact position according to the operation of moving the body of the insertion plug to one direction is preformed. When each the inversion portion is inverted to be moved to the non-contact position by the operation of moving the body of the insertion plug to one direction is performed, the off-operation is performed. In addition, the insertion plug comprises the driving members. Each the driving member of the insertion plug is configured to push the inversion portion which is located in the non-contact position when the operation of moving the body of the insertion plug to an opposite direction opposite of the one direction is performed. When the operation of moving the body of the insertion plug to an opposite direction is performed, each the inversion portion is inverted to be moved from the non-contact position to the contact position.

Effect of the Invention

According to the invention, the inversion springs which comprise the inversion portion is inverted to be moved between the contact position and the non-contact position. Therefore, inversion springs are moved to come into contact with the blade or moves to be spaced from the blades. Therefore, it is possible to make a contact of the inversion spring to the blade in a short time. In addition, it is possible to move the inversion spring to be spaced from the blade in a short time. Therefore, it is possible to shorten the period of time when the arc current flows. Consequently, it is possible to prevent the degradation and the waste of the contact point. In addition, it is possible to improve the safety. Furthermore, in this invention, the period of time required for making a contact of the connection member to the blade is shortened. In addition, the period of time required for moving the connection member to be spaced from the blade is shortened. Consequently, the degradation and the waste of the contact point are prevented. Therefore, this configuration makes it possible to eliminate the need of employing the high-value resistance connector, as the connection member, separate from the low-value resistance connector. Furthermore, at least one of the on-operation and the off-operation is performed according to the movement of the body of the insertion plug when the insertion plug is attached and detached. Therefore, it is possible to eliminate the operation other than operation of moving the body of the insertion plug. Consequently, it is possible to improve the operability.

BRIEF EXPLANATION OF THE DRAWINGS

FIG. 1A to FIG. 1C show connecting operations of the plug-in connectors for DC wiring.

FIG. 2A to FIG. 2C show continuation of the connecting operations of the plug-in connectors for DC wiring.

FIG. 3A to FIG. 3C show the removing operations of the plug-in connectors for DC wiring.

FIG. 4A to FIG. 4C show connecting operations of the plug-in connectors for DC wiring.

FIG. 6A to FIG. 6C show removing operations of the plug-in connectors for DC wiring.

FIG. 7A to FIG. 7C show removing operations of the plug-in connectors for DC wiring.

BEST MODE FOR CARRYING OUT THE INVENTION

Hereinafter, an explanation of the embodiment in this invention is made with attached drawings.

(First Embodiment)

Figure 1A:
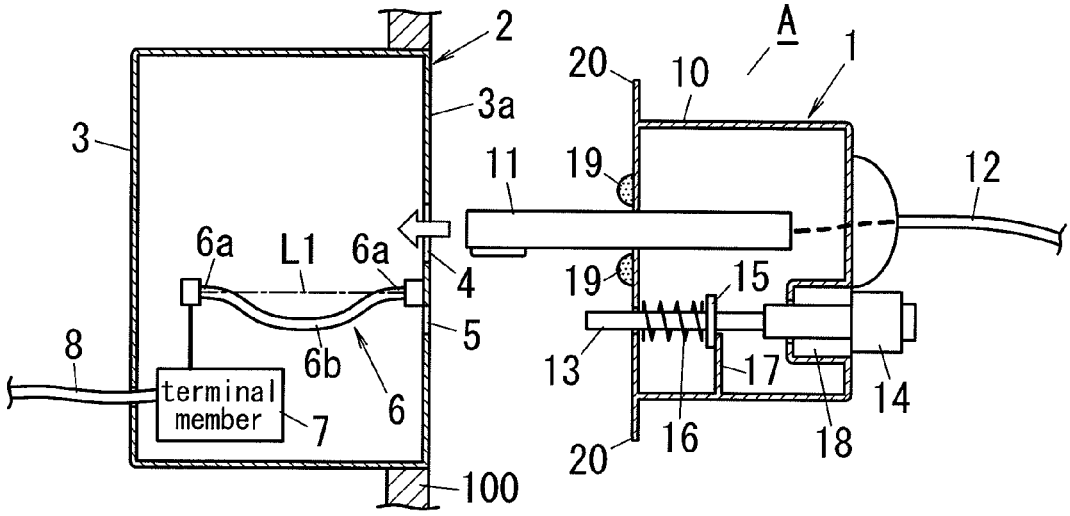
FIG. 1A to FIG. 1C show side cross sectional views of the plug-in connectors for DC wiring in the first embodiment.

The explanation of the first embodiment in this invention is made with FIG. 1A to FIG. 3C. This embodiment discloses the plug-in connector for DC wiring A which comprises an insertion plug 1 and an electrical outlet 2. The insertion plug 1 is detachably attached to the electrical outlet 2. Hereinafter, the explanation is made under a definition that an upper-lower direction in FIG. 1A is defined as an upper-lower direction and a direction perpendicular to the plane of paper in FIG. 1A is defined as a lateral direction.

The electrical outlet comprises a body 3 which is made of synthetic resin. The electrical outlet is embedded in the building surface such that a front surface of the electrical outlet 3 is exposed toward a front. The body 3 has a front surface 3*a* (which is defined by face where the insertion plug 1 is connected). The body 3 is provided at its front surface 3*a* with a pair of the insertion holes 4 where the blades 11 of the insertion plug 1, hereinafter explained. The insertion holes 4 are arranged in the lateral direction. In addition, as shown in FIG. 1A, "one of the insertion holes 5" which corresponds to one of the insertion holes 4 and which is provided for passing one of the driving members 13 is formed in a lower side of the one of the insertion holes 4. In addition, "the other of the insertion holes 5" which corresponds to the other of the insertion holes 4 and which is provided for passing the other of the driving members 13 is formed in an upper side of the other of the insertion holes 4. The driving members 13 are hereinafter explained. In addition, the body 3 houses inversion springs 6 each of which is located between an insertion hole 4 and an insertion hole 5 in the height direction. The inversion spring 6 is configured to contact with the blade 11 or is configured to be spaced from the blade 11. The inversion spring 6 is made of an electrical conductive material having elasticity. The inversion spring has a thin and long plate shape and is curved to have a bow-shape. The inversion spring 6 has both ends 6*a*, 6*a* which are fixed to an inside of the body 3. An intermediate portion 6*b* of the inversion spring 6 is invertible past a line segment which connects both ends 6*a*, 6*a*. The body 3 is provided at its inside with a terminal member 7 which has quick-connection structure and which is connected to a power line 8 introduced from an outside of the body 3. The direct current voltage is applied to the inversion spring 6 through the terminal member 7 from the power line 8. It is noted that, as to the terminal member 7 of the quick-connection structure, a well-known quick connector disclosed in, for example, Japanese patent publication No. 10-144424A is used. Therefore, the illustration and the explanation of the quick connector are omitted.

The insertion plug 1 is a molded product which is made of synthetic resin. The insertion plug 1 has a body 10 formed to have a cylindrical shape, whereby the insertion plug 1 is adapted to be held by the hand. The body 10 has a front surface (which is defined by a surface opposed to the electrical outlet 2), and is provided at its front surface with a pair of blades 11 which are projected toward a front direction. The blades 11 are arranged in the lateral direction. In addition, the body 10 is provided with projections 19 having a hemispherical shape. The projections 19 are located in both an upper side and a lower side of the blade 11. The body 10 has a cable 12 extending from a rear surface of the body 10. The blades 11 are electrically connected to the cable 12.

In addition, the body 10 is provided at its front surface with a driving member 13 having a pole shape. The driving member 13 are inserted into the insertion holes 5 from a position where the driving members 13 are located in positions opposed to the insertion holes 5 of the electrical outlet 2, under a condition where the blades 11 are inserted into the insertion holes 4 of the electrical outlet 2. The driving member 13 is integrally formed with a push button 14 located in the rear surface of the body 10. The driving member 13 is pushed toward a rear direction by a spring force caused by the coil spring 16 interposed between "the flange 15 in an intermediate portion of the driving member 13" and "a front side wall of the body 10". Therefore, when the push button 14 is not pushed, the driving member 13 is pressed by the coil spring 16, as shown in FIG. 1A, whereby the driving member 13 is moved toward the right direction in the illustration. However, when the flange 15 is in contact with the rib 17 provided in an inside wall of the body 10, the driving member 13 is prohibited to move toward a right direction over the rib 17. In addition, the body 10 is provided at its rear surface with a recess which is provided for receiving the push button 14. When the push button 14 is pushed, the driving member 13 is moved toward a left direction, in FIG. 1A, against the spring force of the coil spring 16.

In addition, the outer periphery of the front end of the body 10 is provided with an attachment plate 20 extending outwardly of the body 10. The attachment plate 20 is provided with a screw insertion hole (not shown in the illustration) where the screw 21 hereinafter explained is inserted.

Hereinafter, the operation of inserting the insertion plug 1 into the electrical outlet 2 by the user is explained with FIG. 1 and FIG. 2. As shown in FIG. 1A, firstly, the insertion plug 1 is positioned near the front surface 3*a* of the electrical outlet 2 under a condition where the user holds the body 10 of the insertion plug 1. Then, the blades 11 and the driving members 13 of the insertion plug 1 are inserted into the insertion holes 4, 5 of the electrical outlet 2 (shown in FIG. 1B). Under this condition, the intermediate portion 6*b* of the inversion spring 6 is located in a position opposite of the line segment L1 from the blade 11. Consequently, the blade 11 is spaced from the inversion spring 6. It is noted that, under a condition where the intermediate portion 6*b* is located in the non-contact position, the inversion spring 6 has a shape and a position to be spaced from the blade 11 by a distance for preventing the flowing of the arc. The distance may be arbitrarily set according to the electrical specification.

Figure 1B:
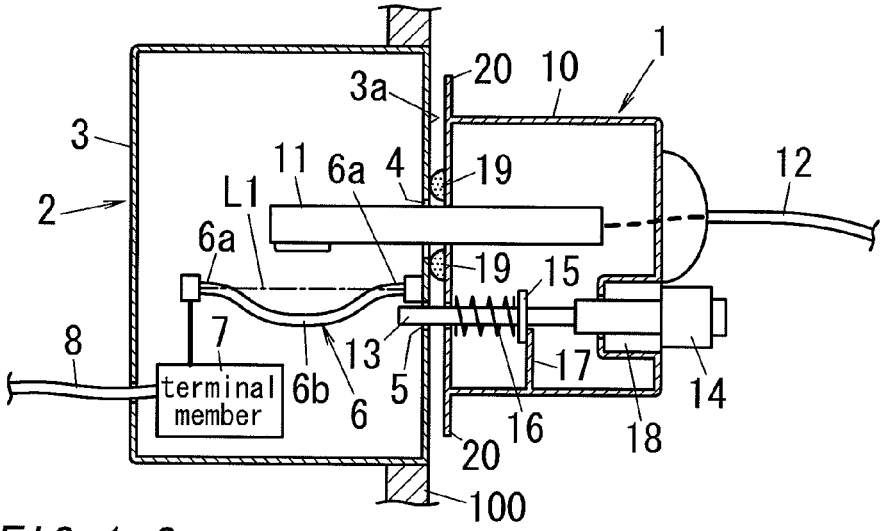
Figure 1C:
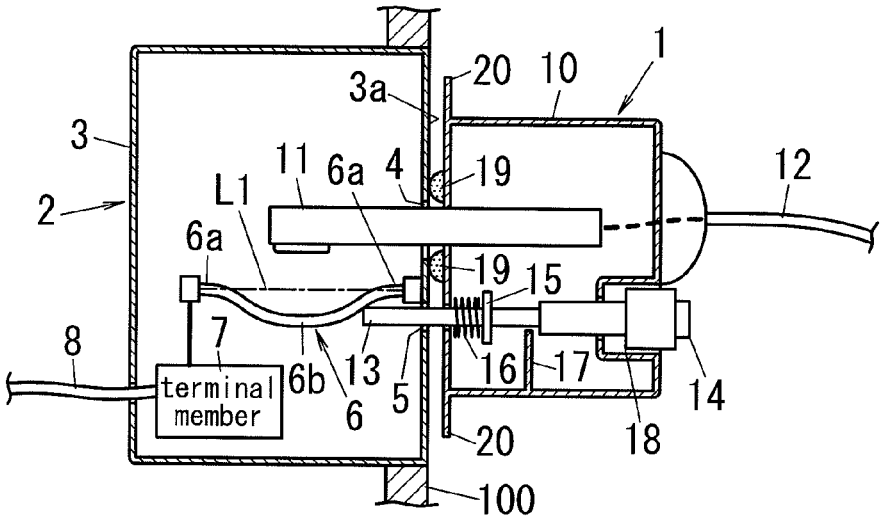
Figure 2A:
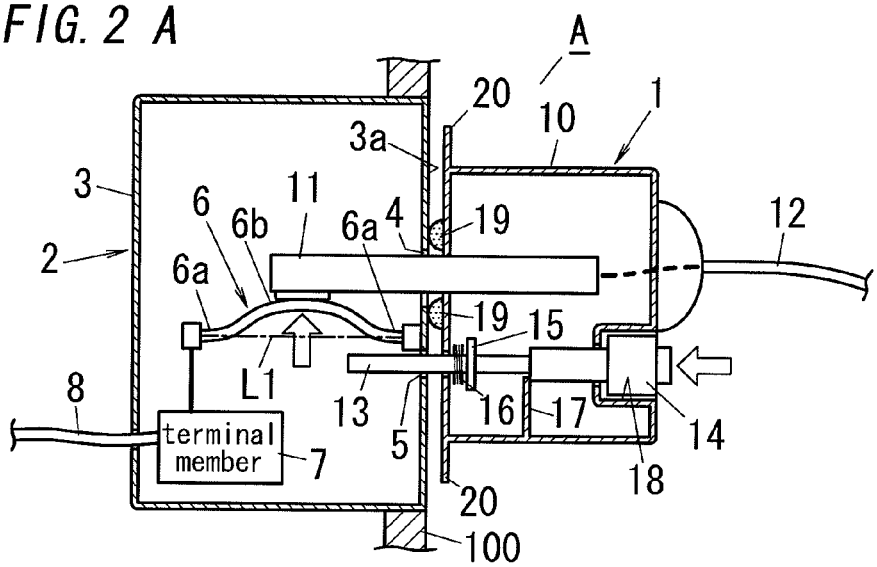
FIG. 2A to FIG. 2C show side cross sectional views of the plug-in connectors for DC wiring in the first embodiment.

In addition, under the condition shown in FIG. 1B, the projections 19 of the insertion plug 1 are in contact with the front surface 3*a* of the electrical outlet 2. Consequently, the insertion plug 1 may have a constant position. Consequently, it is possible to prevent the oscillation of the insertion plug 1.

Then, when the push button 14 on the rear surface of the insertion plug 1 is pushed by the user from the condition shown in FIG. 1B, the driving member 13 is moved toward a left direction in the illustration against the spring force of the coil spring 16. Consequently, the front end of the driving member 13 comes into contact with the intermediate portion 6*b* of the inversion spring 6. When the user further pushes the push button 14, the intermediate portion 6*b* of the inversion spring 6 is pushed toward the line segment L1. Consequently, the inversion spring 6 is elastically deformed and stores the spring force. Then, when an amount of the pressure exceeds the critical point, the spring force stored in the inversion spring 6 is released. As a result, the inversion spring 6 is inverted such that the inversion spring 6 moves to the opposite side past the line segment L1. Consequently, the intermediate portion 6*b* of the inversion spring 6 is moved toward a contact position in a short time, whereby the intermediate portion 6*b* comes into contact with the blade 11.

Figure 2B:
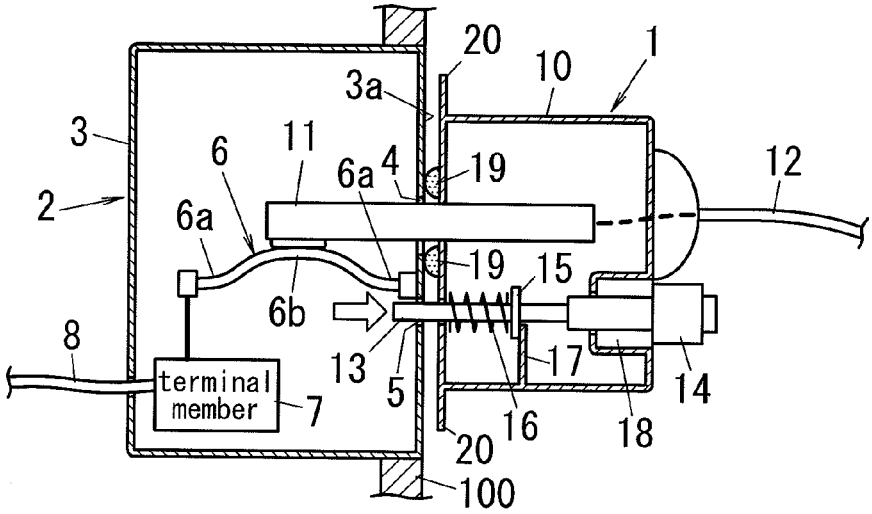
Figure 2C:
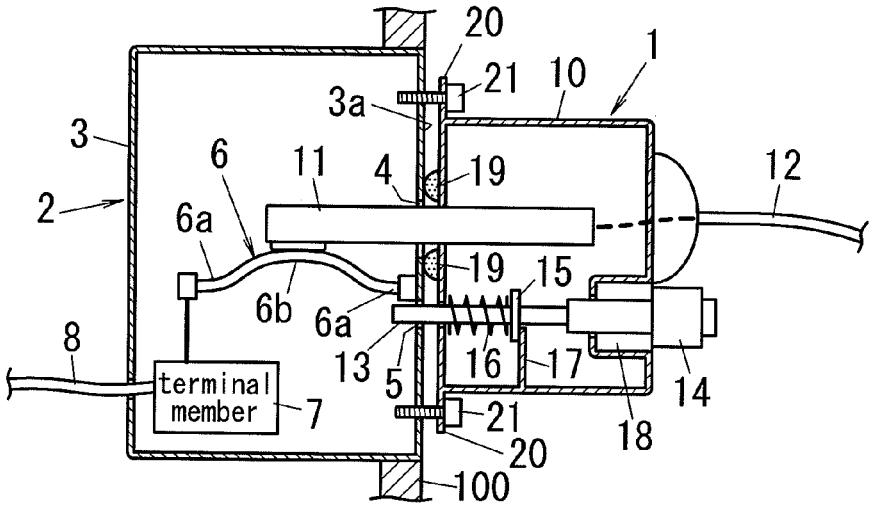

Then, when the user stops pushing the push button 14, as shown in FIG. 2B, the coil spring 16 applies the spring force to the driving member 13 to move the driving member 13 toward a right direction in the illustration. Consequently, the inversion spring 6 and the blade 11 are electrically connected. Therefore, the insertion plug 1 is maintained its position with a condition where the insertion plug 1 is connected to the electrical outlet 2. Finally, as shown in FIG. 2C, the screw 21 is inserted into the screw insertion hole (not shown in the illustration) of the attachment plate 20 of the body 10. When the screw 21 is inserted into the screw insertion hole of the electrical outlet 2, the insertion plug 1 is fixed under a condition where the insertion plug 1 is connected to the electrical outlet 2. It is noted that, even if the screw is not used and the screw fixation is not made, the inversion spring 6 is in contact with the blade 11. Therefore, according to the spring force of the inversion spring 6, the insertion plug 1 is held by the electrical outlet 2. However, if the screw 21 is used to establish the screw fixation, it is possible to prevent the failing of the insertion plug 1, certainly.

Figure 3A:
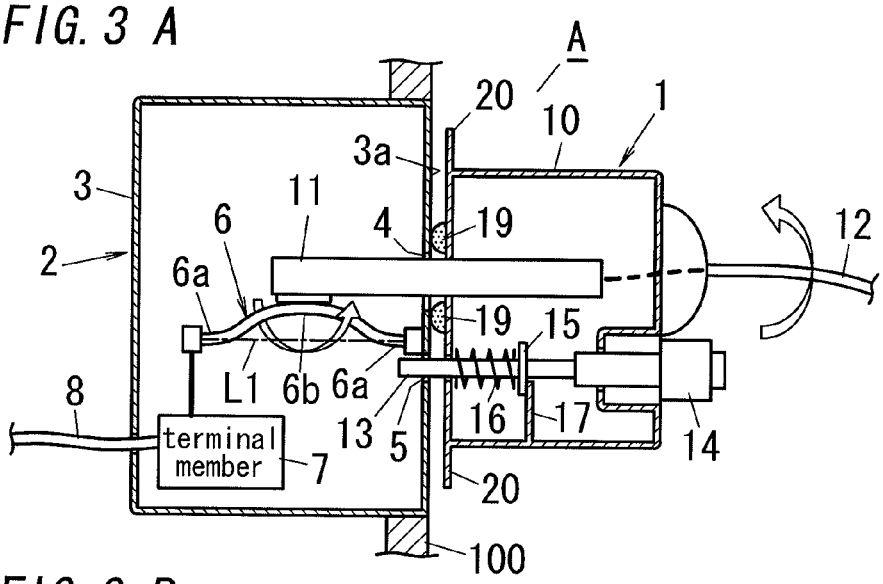
FIG. 3A to FIG. 3C show side cross sectional views of the plug-in connectors for DC wiring in the first embodiment.
Figure 3B:
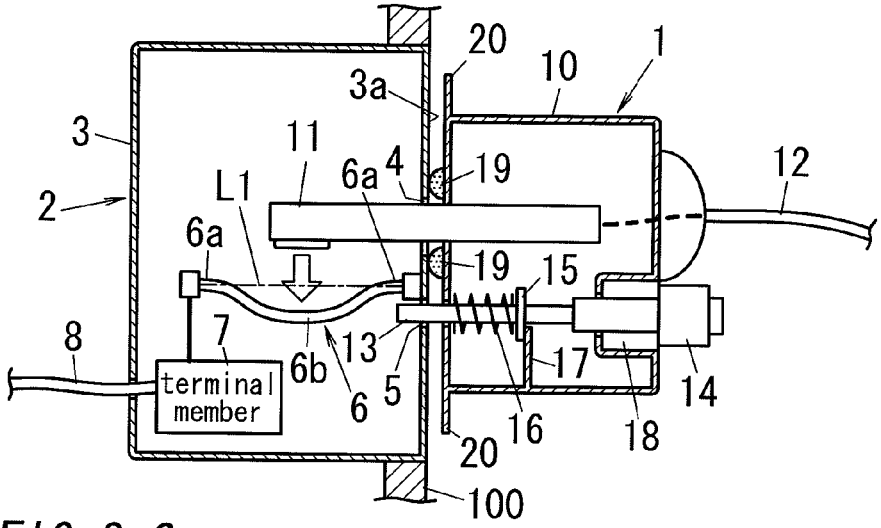
Figure 3C:
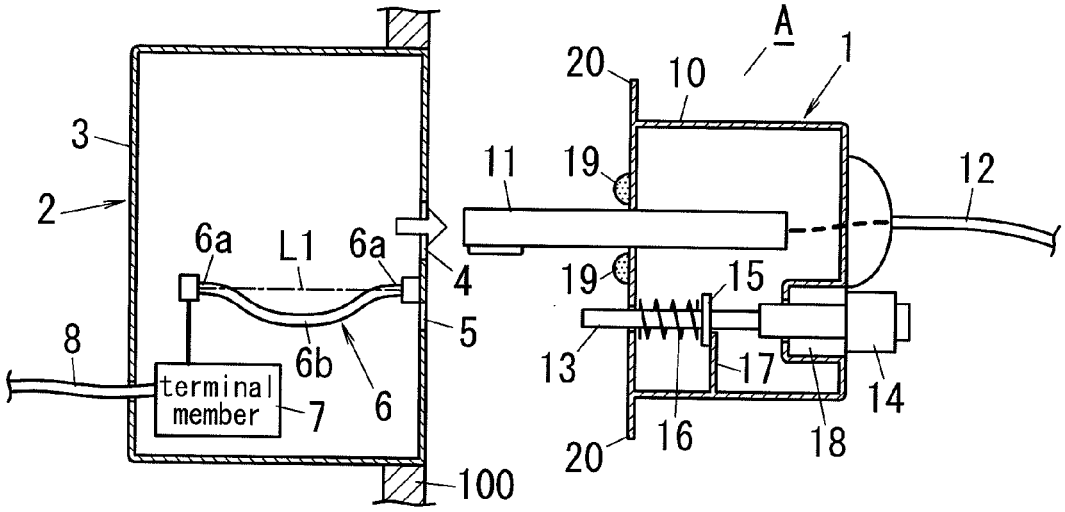

Next, the operation of removing the insertion plug 1 from the electrical outlet 2 is explained with FIG. 3. As shown in FIG. 3A, the screw 21 is unscrewed by the user under a condition where the inversion springs 6 are in contact with the blades 11. Then, the body 10 is rotated about a rotation axis which is in parallel with a front-rear. When the body 10 is rotated, the blades 11 which are paired and laterally arranged push the intermediate portions 6*b* toward the non-contact position, respectively. Consequently, the inversion spring 6 is elastically deformed and stores the spring force. Then, when an amount of the pressure applied to the inversion spring 6 from the blade 11 exceeds the critical point, the spring force stored in the inversion spring 6 is released. As a result, the inversion spring 6 is inversed to be moved past the line segment L1. In this manner, the intermediate portion 6*b* of the inversion spring 6 is moved toward the non-contact position in a short time. (Refer to FIG. 3) When the inversion spring 6 is moved away from the blades 11, the force for holding the blades 11 is lost. Consequently, if the user pulls the body 10 of the insertion plug 1 toward a rear direction, the blades 11 and the driving members 13 are pulled out from the insertion holes 4, 5.

As explained above, the plug-in connector for DC wiring in this embodiment comprises the inversion springs 6 which are defined as a connection member. The inversion springs 6 are configured to be inverted to move between the contact position and the non-contact position. Consequently, the inversion springs 6 come into contact with the blades 11 or are moved to be spaced away from the blades 11. In addition, according to the operation of moving the body 10 of the insertion plug 1, the blades 11 push the inversion portions of the inversion springs 6. Consequently, the off-operation is made. According to the push operation of pushing the push button 14, the driving members 13 push the inversion portions of the inversion springs 6, whereby the on-operation is made. Therefore, it is possible to make a contact of "the inversion portion of the inversion spring 6" to the blade 11 in a short time. (It is possible to make a contact of the intermediate portion of the inversion spring 6 to the blade 11 in a short time.) Furthermore, it is possible make a space between "the inversion portion of the inversion spring 6" and "the blade 11" in a short time. (It is possible to make the space between "the intermediate portion of the inversion spring 6" and "the blades 11" in a short time. That is, this configuration makes it possible to shorten the period of time for making a contact of the blade 11 to the inversion spring 13 which is defined as the connection member. Similarly, this configuration makes it possible to shorten the period of time for making the space between the inversion spring 13 and the blade 11. Therefore, it is possible to shorten the period of time when the arc current flows. Therefore, it is possible to prevent the degradation and the waste of the inversion spring 6 and the blade 11 which are defined as the contact point. In addition, it is possible to improve the safety. In addition, unlike the plug-in connector for DC wiring disclosed in the PATENT LITERATURE 1, there is no need to employ the high-value resistance connector which is separate from the low-value resistance connector. Therefore, it is possible to manufacture the plug-in connector for DC wiring with low cost.

In addition, the operation (specifically, the off-operation) of inverting the inversion spring to move to the non-contact position is made according to operation of moving the body 10 when the insertion plug 1 is removed. (In this embodiment, the operation (specifically, the off-operation 9 of inverting the inversion spring is made according to the operation of twisting the body 10.) Therefore, there is no need to perform the operation other than the operation of moving the body 10. Therefore, this configuration makes it possible to improve the operability.

(Second Embodiment)

The explanation of the second embodiment of this invention is made with FIG. 4 to FIG. 7. In the plug-in connector of the first embodiment, the off-operation is made according to the operation of rotating the body 10 of the insertion plug 1 in one direction under a condition where the insertion plug 1 is inserted into the electrical outlet 2. In addition, when the push operation of pushing the push button 14 of the insertion plug 1 is made under the off condition, the on-operation is performed. However, in the plug-in connector for DC wiring of this embodiment, the off-operation is made according to the operation of moving the body 10 of the insertion plug 1 in the one direction under a condition where the insertion plug 1 is inserted into the electrical outlet 2. In addition, the plug-in connector for DC wiring of this embodiment, the on-operation is made according to the operation of moving the body 10 of the insertion plug 1 in the opposite direction, opposite to the one direction, under the condition where the insertion plug 1 is inserted into the electrical outlet 2.

Figure 4A:
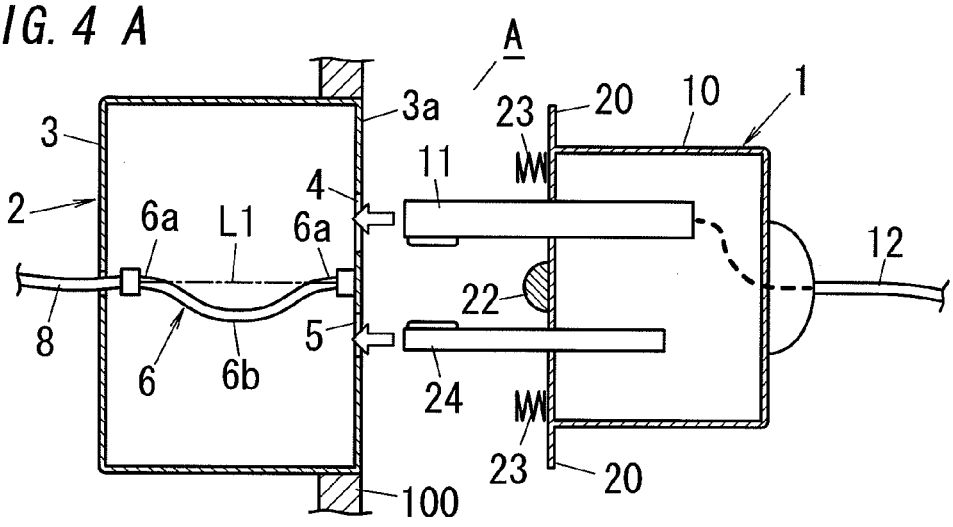
FIG. 4A to FIG. 4C show side cross sectional views of the plug-in connectors for DC wiring in the second embodiment.

As shown in FIG. 4A, the electrical outlet 2 comprises the body 3. The body 3 is made of synthetic resin. The body 3 is embedded in the installation member 100. The body 3 has the front surface 3*a* (to which is defined by a surface where the insertion plug 1 is connected). The body 3 is provided at its front surface 3*a* with a pair of the insertion holes 4. The insertion holes 4 are provided for inserting the blades 11 of the insertion plug 1 hereinafter explained. The insertion holes 4 are arranged in the lateral direction. In addition, the body 3 is provided at it front surface 3*a* with a pair of the insertion holes 5 each of which is located in the lower side of each the insertion hole 4. The insertion holes 5 are provided for inserting the pressing member 24, hereinafter explained, of the insertion plug 1. In addition, the body 3 is provided at its inside with the inversion springs 6 each of which is located between the insertion hole 4 and the insertion hole 5 in the height direction. The inversion spring 6 is configured to contact with and spaced away from the blade 11. The inversion spring 6 is made of an electrical conductive material to have the elasticity. The inversion spring 6 has the thin and long plate shape. The inversion spring 6 is curved to have a bow-shape. The both ends 6*a*, 6*a* of the inversion spring 6 are fixed within the body 3. The intermediate portion 6*b* of the inversion spring 6 is invertible to move past a line segment which connects both ends 6*a*, 6*a*. In addition, the power line 8 is inserted into the body 3. The direct current voltage is applied to the inversion spring 6 through the power ling 8.

The insertion plug 1 is a molded product made of the synthetic resin, as shown in FIG. 4A. The insertion plug 1 has a body 10 having a cylindrical shape, whereby the insertion plug 1 has a size adapted to be held by the hand. The body 10 has a front surface (which is defined by a surface opposed to the electrical outlet 2). The body 10 is provided at its front surface with a pair of the blades 11 which are arranged in the lateral direction. The body 10 is provided at its front surface with pressing members 24 having pole shapes, respectively. The pressing members 24 have positions opposed to a pair of the insertion holes 5 under a condition where the blades 11 are inserted into the insertion holes 4. The pressing members 24 are inserted into the insertion holes 5, respectively. In addition, the front surface of the body 10 has an intermediate portion which is located between the blade 11 and the pressing member 24. The body 10 is provided at its intermediate portion with supporting projections 22 which have hemispherical shapes. The supporting projections 22 are defined as the fulcrum point. Both the upper end and the lower end of the front surface of the body 10 are provided with coil springs 23, 23, respectively. The coil springs 23 are arranged to be spaced from the supporting projection to leave approximately equal distance, respectively. In addition, the cable 12 extends from the rear surface of the body 10. The blades 11 are electrically connected to the cable 12. A pair of the pressing members 24 are electrically insulated from the blades 11.

Next, the explanation of the operation of connecting the insertion plug 1 to the electrical outlet 2 is made with FIG. 4 and FIG. 5. As shown in FIG. 4A, the blades 11 and the pressing members 24 of the insertion plug 1 are aligned with the insertion holes 4 and insertion holes 5 of the electrical outlet 2 by the user. Then, the insertion plug 1 is moved toward the front surface of the electrical outlet 2. Consequently, the blades 11 are inserted into the insertion holes 4 corresponding to the blades 11. The pressing members 24 are inserted into the insertion holes 5 corresponding to the pressing members 24. (Refer to FIG. 4B) In this condition, the intermediate portion 6*b* of the inversion spring 6 is projected toward a portion opposite of the line segment L1 from the blades 11. Therefore, the blade 11 is spaced from the inversion spring 6. In addition, the inversion spring 6 is set to have a shape and an arrangement such that the inversion spring 6 is spaced from the blades 11 by a distance of prohibiting the flow of the arc under the condition where the intermediate portion is located in the non-contact position where the intermediate portion 6*b* is spaced from the blades 11. The distance may be arbitrarily set according to the electrical specification.

Figure 4B:
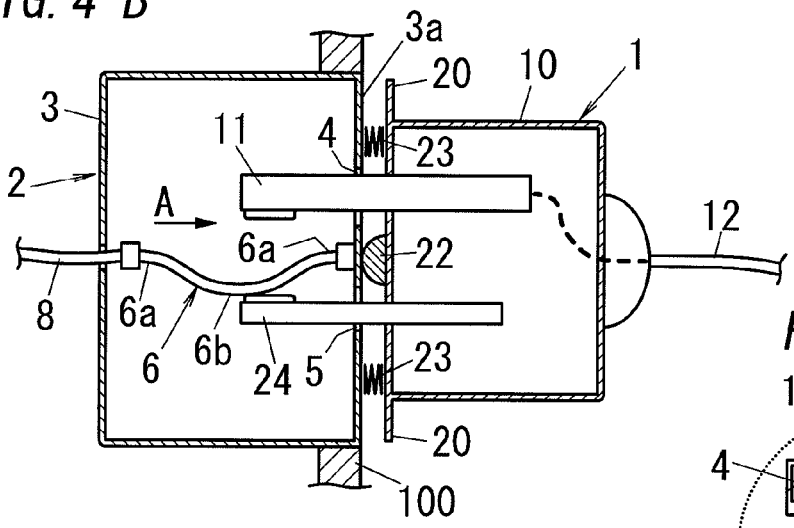
Figure 4D:
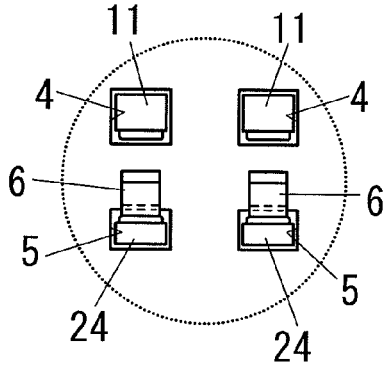
FIG. 4D shows a view seen along an arrow of A in FIG. 4B.

Further in the condition shown in FIG. 4B, the supporting projections 22 of the insertion plug 1 is in contact with the front surface 3*a* of the electrical outlet 2. Consequently, the body 10 of the insertion plug 1 is supported to be swing about a center defined by the supporting projection 22. If the force of inclining the body 10 is not applied, the coil springs 23 in both the upper side and the lower side of the supporting projections 22 generate the spring force. According to the spring force, the body 10 is positioned such that the normal direction of the front surface 3*a* of the electrical outlet 2 and the front-back direction of the body 10 are aligned with each other.

Figure 4C:
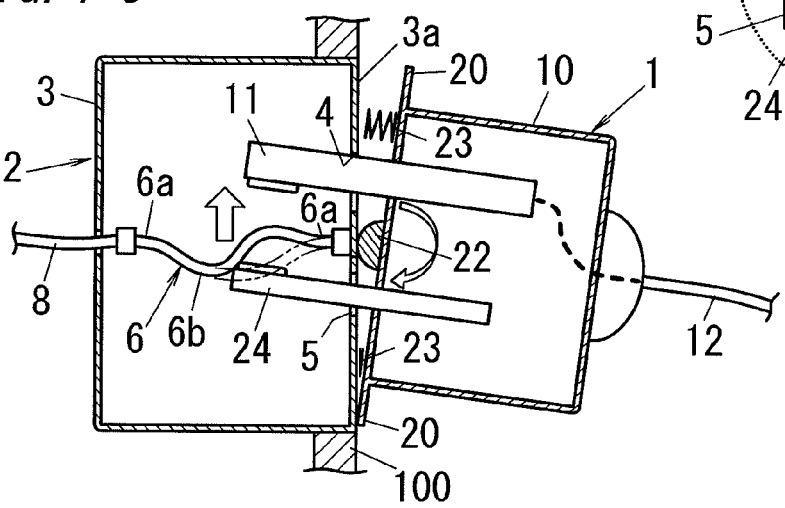

Under this condition, the body 10 is rotated in the clockwise rotation direction in FIG. 4C about the supporting projections 22 by the user such that the pressing members 24 are inclined to be directed in the anterosuperior direction. In this condition, the pressing member 24 pushes the intermediate portion 6*b* of the inversion spring 6. Consequently, the inversion spring 6 is elastically deformed. Therefore, the spring force is stored in the inversion spring 6. Then, when an amount of the pressure applied to the inversion spring 6 from the pressing member 24 exceeds the critical point, the inversion spring 6 releases the spring force stored in the inversion spring 6. Consequently, the inversion spring 6 is inverted to move toward an opposite side past the line segment L1. Consequently, the intermediate portion 6*b* is moved to the contact position where the intermediate portion 6*b* is in contact with the blade 11 in a short time. (Refer to FIG. 5A and FIG. 5D.) In addition, under this condition, the coil spring 23 in the lower side 23 is compressed. Therefore, the coil spring 23 in the lower side generates the reaction force.

Figure 5A:
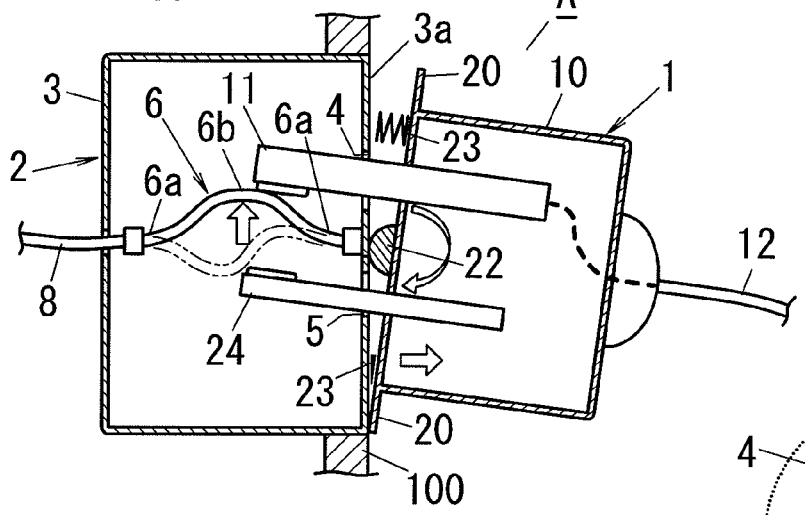
FIG. 5A to FIG. 5C show side cross sectional views of the plug-in connectors for DC wiring following to the above connection operation.
Figure 5D:
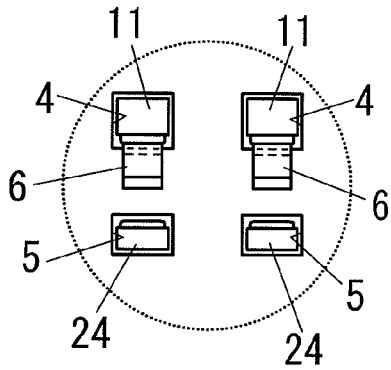
FIG. 5D shows a view seen along an arrow of A in FIG. 5B.
Figure 5B:
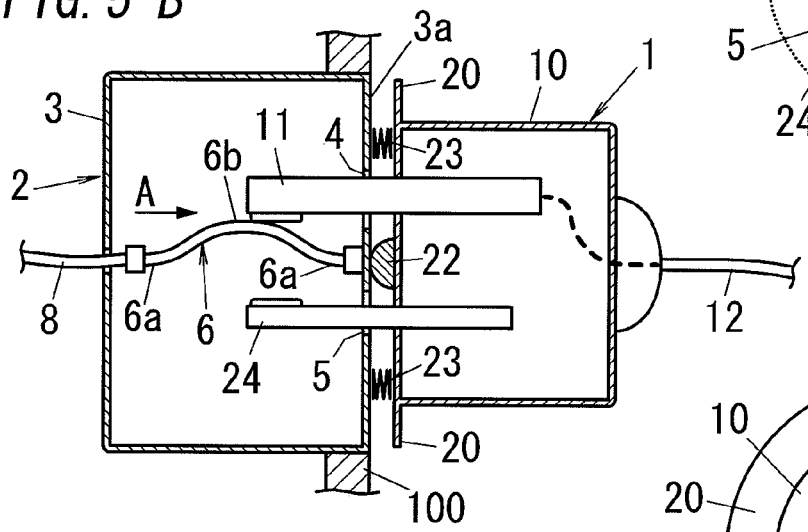
Figure 5E:
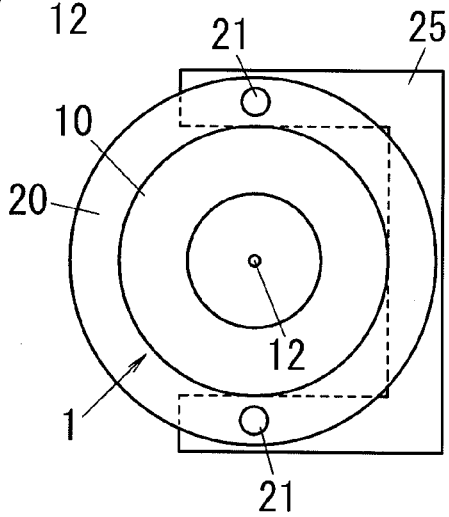
FIG. 5E shows a view seen along an arrow of G in FIG. 5C.
Figure 5C:
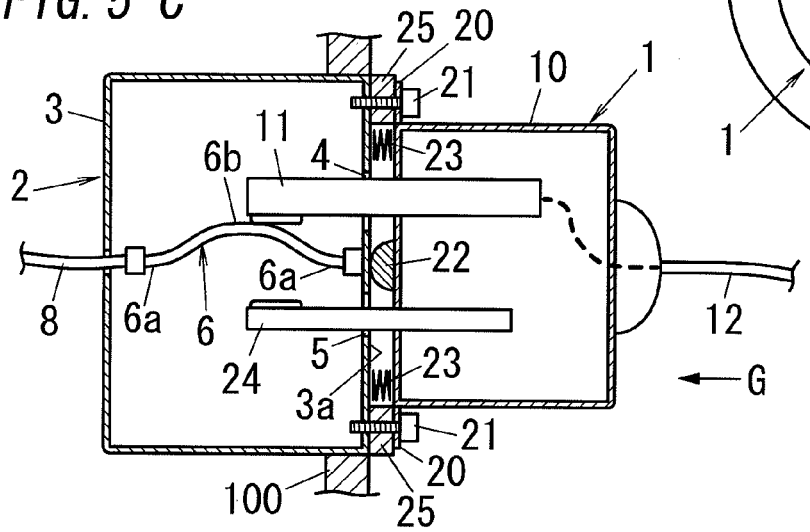
Figure 6A:
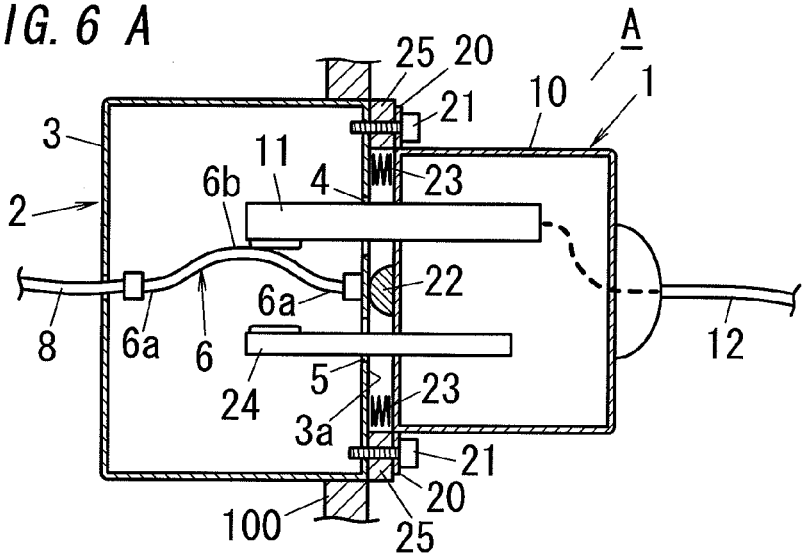
FIG. 6A to FIG. 6C show cross sectional views of the plug-in connectors for DC wiring.
Figure 6B:
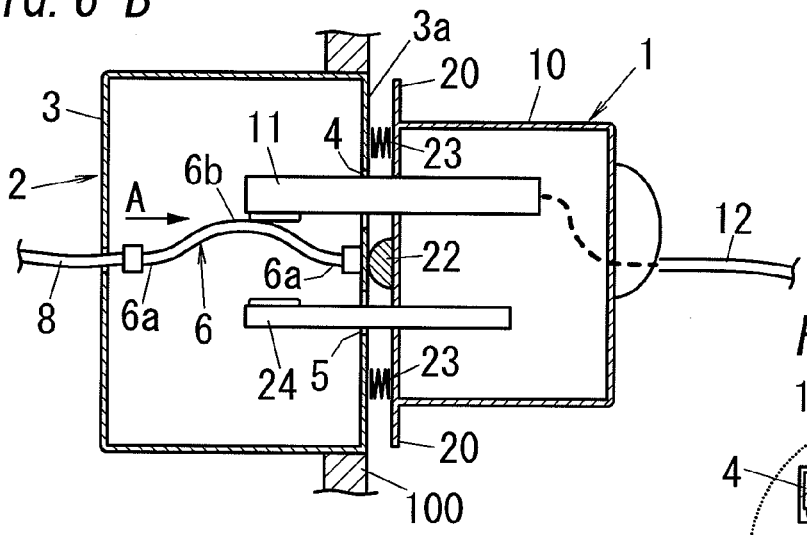
Figure 6D:
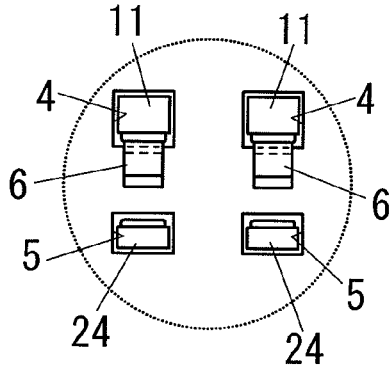
FIG. 6D shows a view seen along an arrow of A in FIG. 6B.
Figure 6C:
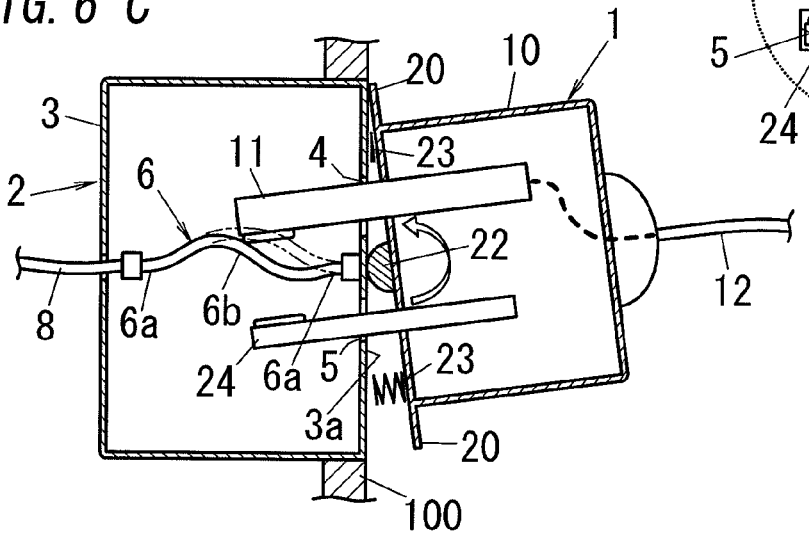

Then, when the user finish inclining the body 10 rearwardly, the reaction force of the coil spring 23 in the lower side rotates the body 10 in the counterclockwise direction in FIG. 5B about a center which is defined by the supporting projection 22. Consequently, the body 10 is moved to have a condition where the front-back direction of the body 10 is aligned with the normal direction of the front surface 3*a* of the electrical outlet. (Refer to FIG. 5B.) Finally, as shown in FIG. 5C and FIG. 5E, the screw 21 is inserted into the screw insertion hole (not shown in the illustration) of the attachment plate 20 of the body 10 with the spacer which is interposed between the body 10 and the front surface 3*a* of the electrical outlet 2. The spacer 25 has a C-shape when seen in the planar view. Then, the screw 21 is screwed into the screw insertion hole of the electrical outlet 2. Consequently, the insertion plug 1 is fixed under a condition where the insertion plug 1 is connected to the electrical outlet 2. It is noted that the insertion plug 1 is held by the electrical outlet 2 by the elastic force of the inversion spring 6 by the contact of the inversion spring 6 with the blade 11, even if the screw fixation is not made by the screw 21. However, if the screw 21 is used to establish the screw fixation, it is possible to prevent the failure of the insertion plug 1, steadily.

Next, the operation of removing the insertion plug 1 from the electrical outlet 2 is explained with FIG. 6 and FIG. 7. As shown in FIG. 6A and FIG. 6 D, the screw 21 is removed by the user under a condition where the inversion spring 6 is in contact with the blade 11. (Refer to FIG. 6B). Then, as shown in FIG. 6C, when the user rotates the body in the counterclockwise direction in FIG. 6C about the center defined by the supporting projection 22, the blade 11 pushes the intermediate portion 6*b* of the inversion spring 6. (When the user forwardly inclines the body 10 about the center defined by the supporting projection 22, the blade 11 pushes the intermediate portion 6*b* of the inversion spring 6.) Consequently, the inversion spring is elastically deformed. As a result, the spring force is stored in the inversion spring 6.

Figure 7A:
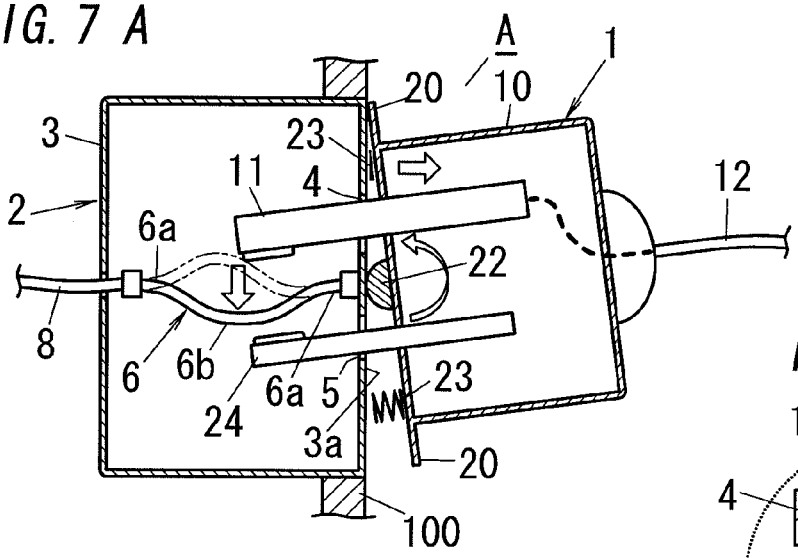
FIG. 7A to FIG. 7C show cross sectional views of the plug-in connectors for DC wiring following to the above connection operation.
Figure 7D:
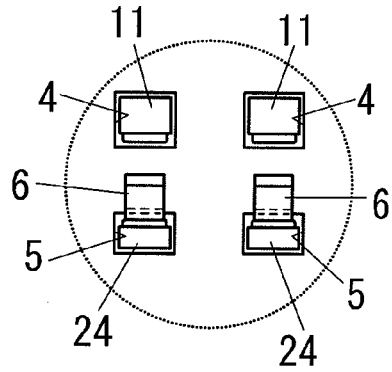
FIG. 7D shows a view seen along an arrow of A in FIG. 7B.

When the blades 11 applies "the pressure having an amount which exceeds the critical point of the inversion spring" to the inversion spring 6, the spring force stored in the inversion spring 6 is released, as shown in FIG. 7A. When the inversion spring 6 is inverted to be moved toward the opposite side past the line segment L1, the intermediate portion 6*b* is moved toward the non-contact position in a short time. (Refer to FIG. 7D) Then, the inversion spring 6 releases the spring force stored in the inversion spring 6 at once. Consequently, the inversion spring 6 having the contact condition of contacting with respect to the blade 11 is moved to the non-contact position in a short time. Therefore, the period of time when the arc current flows between the contact points is short. (That is, the period of time when the arc current flows between the blade 11 and the inversion spring 6 is short.) Therefore, it is possible to prevent the degradation and the waste of the blade 11 and the inversion spring 6. Therefore, it is possible to improve the safety. In addition, in this condition, the coil spring 23 in the upper side is compressed. Therefore, the coil spring 23 in the upper side generates the reaction force.

Figure 7B:
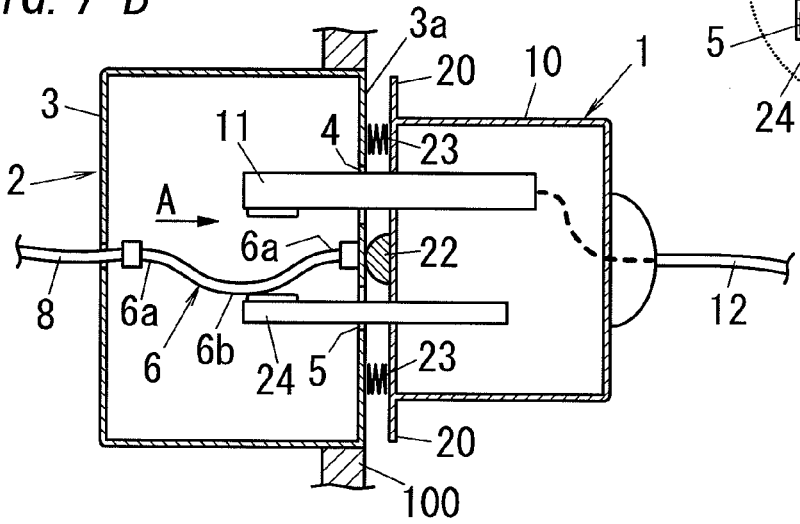
Figure 7C:
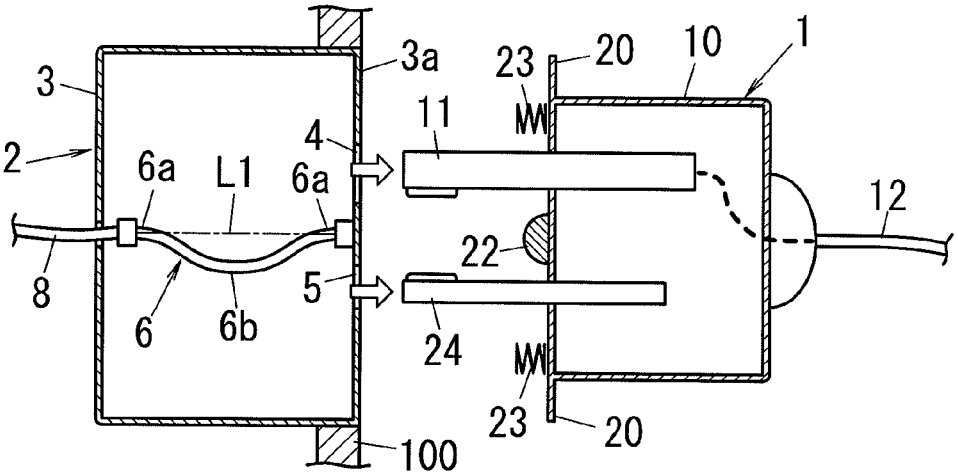

Then, when the user finishes inclining the body 10 forwardly, the coil spring 23 in the upper side releases the reaction force to rotate the body 10 in the clockwise direction in FIG. 7B about the center defined by the supporting projection 22. Consequently, the body 10 is moved such that the front-back direction of the body 10 is aligned with the normal direction of the front surface 3*a* of the electrical outlet 2. (Refer to FIG. 7B) Finally, as shown in FIG. 7C, when the user pulls out the body 10 of the insertion plug 1 toward the rear direction, the blades 11 and the pressing members 24 are pulled out from the insertion holes 4 and 5. Consequently, the insertion plug 1 is removed from the electrical outlet 2.

As explained above, the plug-in connector for DC wiring in this embodiment comprises the inversion spring 6 which is defined as the connection member. The inversion spring 6 is configured to invert between the contact position and the non-contact position. Consequently, the inversion spring 6 is in contact with the blades 11 or is spaced from the blades 11. Therefore, the inversion portion of the inversion spring 6 is allowed to come into contact with the blades 11 in a short time, and is allowed to be spaced away from the blades 11 in a short time. (The inversion portion is, in other words, the intermediate portion 6*b*.) Therefore, the period of time required for making a contact of "the inversion spring 6 defined as the connection member" to the blade 11 is shortened. In addition, the period of time required for making a space of moving the inversion spring 6 away from the blade 11 is also shortened. Therefore, it is possible to shorten the period of time when the arc current flows. Therefore, it is possible to prevent the degradation and the waste of the contact points. This results in the improvement of the safety. In addition, unlike the plug-in connector for DC wiring disclosed in the PATENT LITERATURE 1, there is no need to employ the high-value resistance connector which is separate from the low-value resistance connector. Therefore, it is possible to manufacture the plug-in connector for DC wiring with low cost.

In addition, in this embodiment, according to the operation of moving the body 10 of the insertion plug 1 to one direction, the inversion portion the inversion spring 6 in the contact position is pushed by the blade 11. (In this embodiment, according to the operation of inclining the body 10 of the insertion plug 1 toward the anteroinferior direction, the intermediate portion 6*b* of the inversion spring 6 in the contact position is pushed by the blade 11.) Therefore, the intermediate portion 6*b* is inverted to be moved to the non-contact position. Furthermore, according to the operation of moving the body 10 of the insertion plug 1 in the opposite direction which is opposite of the one direction, the inversion portion (in other words, the intermediate portion 6*b*) of the inversion spring 6 in the non-contact position is pushed by the pressing member 24 which is defined as the driving member. (The operation of moving the body of the insertion plug 1 in the opposite direction which is opposite of the one direction is, in other words, the operation of inclining the insertion plug 1 toward the anterosuperior direction.) Consequently, the intermediate portion 6*b* is inverted to be moved to the contact position. That is, in this embodiment, according to the only operation of moving the body 10 of the insertion plug 1 when the plug is detached and attached, the inversion spring 6 is inverted to be moved between the contact position and the non-contact position. Consequently, the contact points defined by the blades 11 and the inversion spring 6 are allowed to have on-condition or off-condition. Therefore, this configuration makes it possible to eliminate the operation of pushing the driving member to push the inversion portion of the inversion spring 6. Therefore, it is possible to improve the operability. In addition, this configuration makes it possible to eliminate the driving member 13 for pushing the inversion portion of the inversion spring 6. Therefore, it is possible to manufacture the plug-in connector for DC wiring with low cost.

Figure 8A:
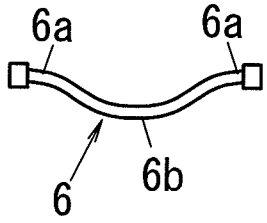
FIG. 8A and FIG. 8B show side cross sectional views of the inversion spring employed in the above.
Figure 8B:
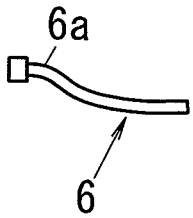

In addition, the inversion spring 6 explained in the above embodiment is made of the electrical conductive material and has an elasticity. Therefore, the inversion spring 6 is formed to have a bow-shape. Both the ends 6*a*, 6*a* of the inversion spring 6 are fixed to the body 3. Consequently, the intermediate portion 6*b* is configured to invertible. However, as shown in FIG. 8B, the inversion spring 6 may be fixed at only one of the ends 6*a*. In this case, the inversion spring 6 has the remaining one of the ends, opposite of the one of the ends, which is defined as the inversion portion which is invertible.

In addition, in the above embodiment, an explanation is made with the electrical outlet 2 which is defined as a plug receiver which is embedded in the installation wall and which is fixed to the device. However, needless to say, it is possible to apply the technological thought of this invention to the plug receiver such as tap equipment which is used without fixation.

INDUSTRIAL APPLICABILITY

As explained above, according to this invention, the inversion spring which is defined as the connection member is inverted to be moved between the contact position and the non-contact position. Consequently, the inversion spring comes into contact with the blade or spaced away from the blade. Therefore, it is possible to establish the connection of the inversion spring to the blade in a short time, and to establish the disconnection of the inversion spring from the blade in a short time. Therefore, it is possible to shorten the period of time when the arc current flows. Therefore, it is possible to prevent the degradation and the waste of the contact point. In addition, it is possible to provide the plug-in connector for DC wiring with improvement of the safety.

Explanation of the Reference Character

A Plug-in connector for DC wiring
1 Insertion plug
2 Electrical outlet
3 Body
4 Insertion hole
5 Insertion hole
6 Inversion spring (Connection member)
6*a* End
6*b* Intermediate portion (Inversion portion)
10 Body
11 Blade
13 Driving member
14 Push button

The invention claimed is:

1. A plug-in connector for DC wiring comprising:

an insertion plug having blades, a plug receiver comprising insertion holes and a connection member, said insertion holes being configured such that said blades are inserted into the insertion holes, said connection member being electrically connected to said blades which are inserted through said insertion holes, said connection member comprising inversion springs, said inversion spring having electrical conductivity and having one end which is fixed, said inversion spring has an inversion portion which is invertible to move between a contact position and a non-contact position past a line segment which connects both ends of said inversion spring, when said inversion portion is in the contact position, said inversion portion is projected toward said blade which is inserted from said insertion hole such that said inversion portion is elastically contacted to said blade, when said inversion portion is in the non-contact position, said inversion portion is spaced from said blade by a predetermined distance or more, the predetermined distance is defined by a distance for cutting a flow of arc, at least one of an on-operation for moving said inversion portion of said inversion spring toward the contact position and an off-operation for moving said inversion portion of said inversion spring toward the non-contact position is performed by pushing said inversion portion with a part of said insertion plug according to operation of moving a body of said insertion plug when said insertion plug is attached and detached.

2. The plug-in connector for DC wiring as set forth in claim 1, wherein according to the operation of moving said body of said insertion plug, said blade which is defined as a part of said insertion plug pushes said inversion portion which is located in the contact position to move the inversion portion to the non-contact position, whereby the off-operation is performed, said insertion plug comprises a driving member, and according to operation of pushing a push button on a surface of the body of the insertion plug, said inversion portion which is located in the non-contact position is pushed, whereby said driving member inverses a position of said inversion portion from the non-contact position to the contact position.

3. The plug-in connector for DC wiring as set forth in claim 1, wherein according to the operation of moving the body of said insertion plug to one direction, said blade which is defined as a part of said insertion plug pushes said inversion portion in the contact position to the non-contact position, whereby off-operation is performed, said insertion plug comprises a driving member, and according to the operation of moving the body of said insertion plug to an opposite direction opposite to the one direction, said inversion portion which is located in the non-contact position is pushed, whereby said driving member inverses a position of said inversion portion from the non-contact position to the contact position.

* * * * *